US010471433B1

(12) United States Patent
Bell

(10) Patent No.: US 10,471,433 B1
(45) Date of Patent: Nov. 12, 2019

(54) SIMPLIFIED LABORATORY TEST TUBE HANDLING DEVICE

(71) Applicant: John Kenneth Alexander Bell, Miami, FL (US)

(72) Inventor: John Kenneth Alexander Bell, Miami, FL (US)

( * ) Notice: Subject to any disclaimer, the term of this patent is extended or adjusted under 35 U.S.C. 154(b) by 108 days.

(21) Appl. No.: 15/878,328

(22) Filed: Jan. 23, 2018

Related U.S. Application Data

(63) Continuation-in-part of application No. 14/749,005, filed on Jun. 24, 2015, now Pat. No. 9,896,317.

(51) Int. Cl.
*B01L 9/06* (2006.01)
*B67B 1/04* (2006.01)
*B67B 7/12* (2006.01)

(52) U.S. Cl.
CPC ..... *B01L 9/06* (2013.01); *B67B 1/045* (2013.01); *B01L 2200/025* (2013.01); *B01L 2300/043* (2013.01); *B67B 7/12* (2013.01)

(58) Field of Classification Search
CPC .. B67B 3/00; B67B 1/00; B67B 1/045; B67B 3/22; B67B 7/12; B67B 7/14; B67B 7/16; B01L 9/06; B01L 2200/025; B01L 2300/043
See application file for complete search history.

(56) References Cited

U.S. PATENT DOCUMENTS 6,109,139 A * 8/2000 Regester ..... B67B 7/00 81/3.09
8,906,321 B2 * 12/2014 Arras ..... B01L 3/523 215/237
2014/0190131 A1 * 7/2014 Bjork ..... B01L 99/00 53/492

FOREIGN PATENT DOCUMENTS

DE 102010029136 A1 * 11/2011 ..... B01L 3/50825
WO WO-2017217655 A1 * 12/2017 ..... B01L 3/561

* cited by examiner

*Primary Examiner* — Christopher R Harmon
(74) *Attorney, Agent, or Firm* — Kajane McManus

(57) ABSTRACT

The present application is directed towards the handling of laboratory test tubes and more particularly to a specialized laboratory device that enables manual opening and capping of multiple test tubes with integral sealing caps, simultaneously. The Simplified Laboratory Test Tube Handling Device permits the user to actively process multiple test tube simultaneously, more simply, efficiently and rapidly than previously possible.

20 Claims, 5 Drawing Sheets

SIMPLIFIED LABORATORY TEST TUBE HANDLING DEVICE

CROSS REFERENCE TO RELATED APPLICATIONS

This application is a continuation in part of U.S. application Ser. No. 14/749,005 filed on Jun. 24, 2015 and entitled LABORATORY TEST TUBE HANDLING DEVICE, the teachings of which are incorporated herein by reference.

FIELD OF INVENTION

The present application is directed towards the handling of laboratory test tubes. More particularly to a specialized laboratory device that enables manual uncapping and re-capping of multiple test tubes with integral sealing caps. The Laboratory Test Tube Handling Device permits the user to perform multiple processes simultaneously more efficiently and rapidly than current practice.

BACKGROUND OF INVENTION

With the lid down and retracted to the front, test tubes to be used, up to the maximum quantity available on the test tube handling device, are inserted into the test tube handling device with the sealing caps closed. The test tube handling device alignment features require that the tubes be inserted with the cap hinges to the back, the cap locking nubs to the front. With the tubes inserted the lid is moved to the back to the engaged first position into the caps to hold the nubs on all inserted test tubes simultaneously. The lid hinge is located on an axis coincident with the axis of rotation of the test tube caps allowing all tubes to be uncapped and held open simultaneously while maintaining the test tubes in the test tube handling device. When needed, all the test tubes are uncapped by raising the lid up, or re-capped and sealed by lowering the lid down with the lid in the engaged first position. The lid is retracted to the front to expose the capped test tubes. The test tube handling device provides access to the necks of the test tubes for marking or labeling as required on the individual test tubes. A lid operating bar is provided to reduce the effort required to lift the lid to uncap the test tube caps using lever action, with a feature to hold open the caps during filling or emptying of the tubes, and with lever action to reduce effort required when re-capping the test tubes. Interlock mechanisms consisting of a tab on either end of the lid and a truncated cylinder on the lid hinge interface with side brackets to ensure that the lid can only be raised after it has been engaged with the test tube cap nubs, and can only be retracted after it has been moved to the down orientation and all test tubes are capped. An extract lever is provided to remove the capped test tubes out of the test tube handling device, after the lid has been retracted, using a downward motion. A removable magnetic strip runs along the back of, and is in contact with, the test tubes should magnetic separation of the test samples be desired. All materials used in the construction of the Laboratory Test Tube Handling Device are capable of withstanding the temperatures of an autoclave when used for cleaning or sterilization.

These and other aspects, features and advantages of the present invention will become more readily apparent from the attached drawings and the detailed description of the preferred embodiments which follow.

SUMMARY OF INVENTION

The present disclosure provides a device that permits handling multiple test tubes simultaneously for uncapping, holding open, and re-capping of test tubes. Laboratory test tubes with integral snap-type sealing caps must be individually handled for opening, filling or emptying, closing and manual agitation if required to mix the contents. An apparatus is proposed enabling multiple test tubes to be located, uncapped, held open for filling or emptying, and re-capped to seal and agitated simultaneously as a batch.

The Laboratory Test Tube Handling Device is configured to be manually operated permitting a user to quickly and efficiently collect samples and cap multiple tubes simultaneously whereby samplings can take place. Numerous receptacle devices are placed in a sequential order when the lid is in the horizontal retracted second position. The Laboratory Test Tube Handling Device is configured with a lid that engages the test tube cap nubs. When the lid is moved to the engaged first position and raised to near-vertical all the test tube caps are simultaneously opened. Once the desired sampling takes place simultaneous capping of numerous receptacle devices can take place by manually moving the lid into the horizontal down orientation. The lid is again retracted to the second position to expose the test tubes. The Laboratory Test Tube Handling Device is configured with a lifting device to assist in simultaneously removing the test tubes from the apparatus. The advantage of using such a device is that it is manually operated and allows the user to reduce effort and quickly perform a desired sampling and obtain results that normally would take considerable time to achieve.

There is a need in the field for a device that allows a user to quickly and efficiently perform multiple sampling manually including the ability to open and close the sampling receptacles, to agitate the samples manually, and to perform magnetic separation if desired with the samples simultaneously.

Further features and embodiments will become apparent from the description and the accompanying drawings and the detailed description of the preferred embodiments which follow.

BRIEF DESCRIPTION OF DRAWINGS

The preferred embodiments of the invention will hereinafter be described in conjunction with the appended drawings provided to illustrate and not to limit the invention, in which.

Figure 1:
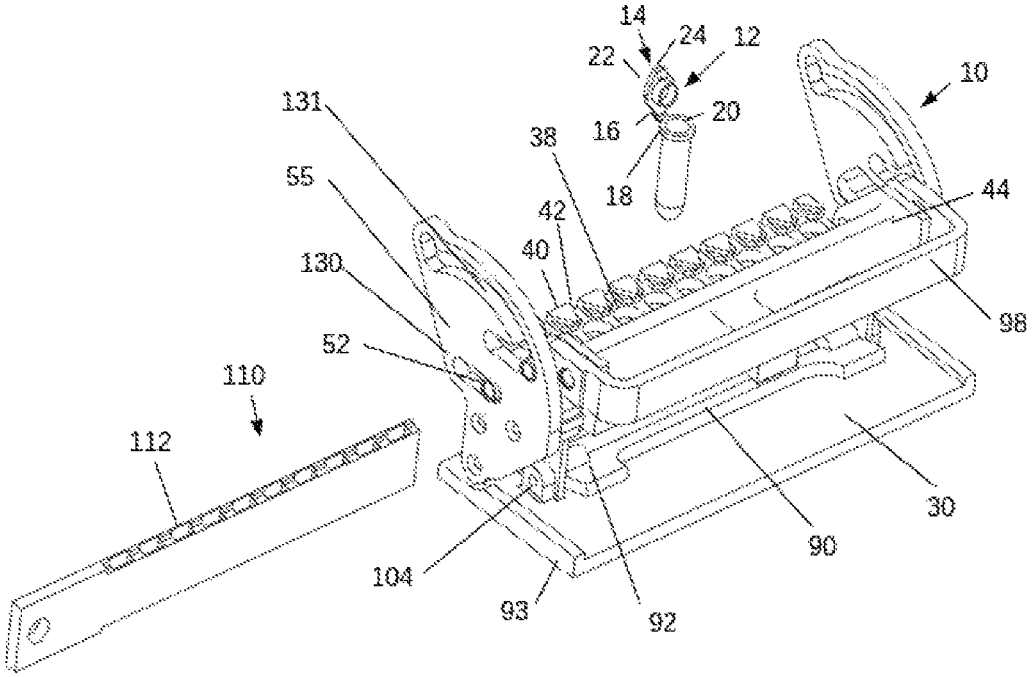
FIG. 1 presents an isometric view of an exemplary Laboratory Test Tube Handling Device in the down and retracted second position.
Figure 2:
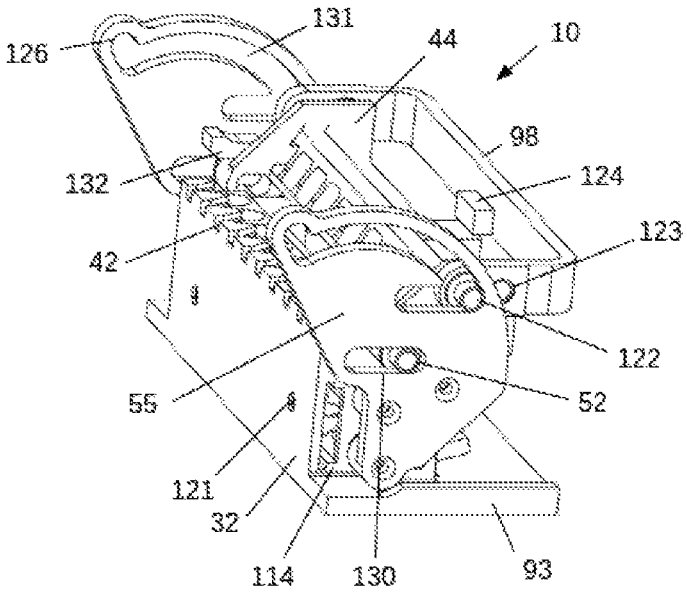
FIG. 2 presents an isometric view of an exemplary Laboratory Test Tube Handling Device in the down and retracted second position.
Figure 3:
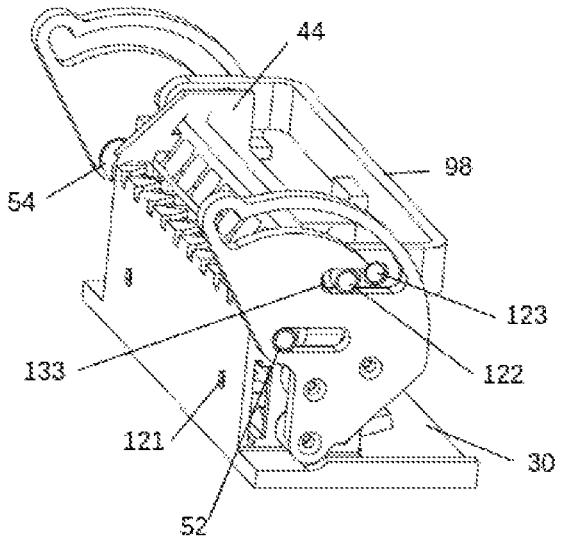
FIG. 3 presents an isometric view of an exemplary Laboratory Test Tube Handling Device in the down and engaged first position.
Figure 4:
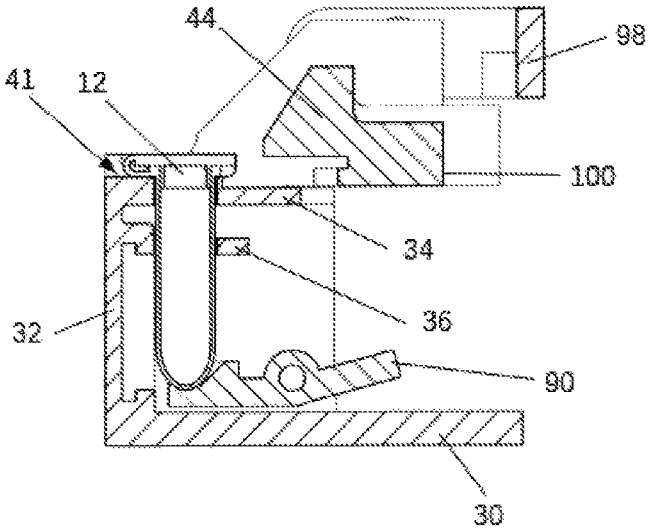
FIG. 4 presents a sectioned view of the exemplary Laboratory Test Tube Handling Device in the down and retracted second position.
Figure 5:
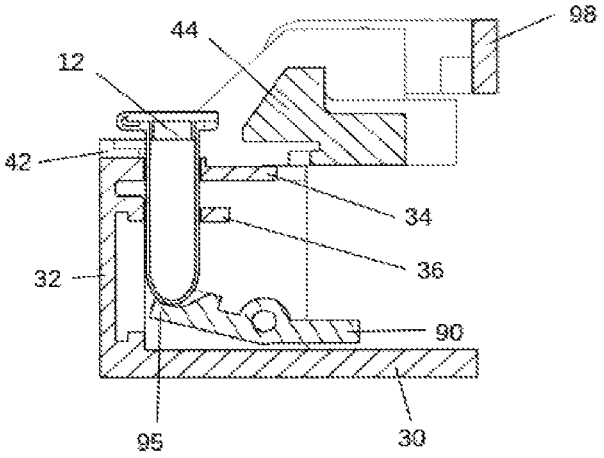
FIG. 5 presents a sectioned view of the exemplary Laboratory Test Tube Handling Device in the down and retracted second position whereby the test tubes are being raised out of the device by lower lever device.

While the various features of this invention are hereinafter described and illustrated as being particularly adapted for providing rigidity to instrument devices the invention is not limited to the embodiments illustrated in the drawings but are merely used to illustrate the wide variety of uses of this invention. Therefore, the foregoing is considered as illustrative only of the principles of the invention. Since numerous modification and changes will readily occur by those skilled in the art, it is not desired to limit the invention to the exact construction and operation shown and described and accordingly, all suitable modifications and equivalents may be resorted to, falling within the scope of the invention.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to the drawings in greater detail, the assembly for opening multiple capped test tubes simultaneously, hereinafter referred to by reference numeral 10, is sized and configured to open a plurality of test tubes 12, each having a cap 14 thereon which incorporates a hinge 16, such as a living hinge 16 on a collar 18 surrounding a mouth 20 of each test tube 12. From the living hinge 16, extending forwardly, as illustrated, is a cover 22 which includes a latching member or nub 24 which fits into a collar 18 to keep the test tubes 12 from accidentally opening. It will be understood that the cover 22 in combination with the nub 18 is referred to as the cap 14, which together securely close the mouth 20 of a corresponding test tube 12.

The assembly 10 thus must accommodate for the hinged cover 22 to open test tubes 12 simultaneously. It will be also understood that the assembly 10 can accommodate any plurality of test tubes 12. In a preferred embodiment, 10 to 12 test tubes are accommodated, though this should not be construed as limiting.

The assembly 10 is illustrated to have a base 30 from which a rear wall 32 extends upwardly extending forwardly from the rear wall 32 and supported thereon are two parallel, planar shelves, a top shelf 34 and lower shelf 36, which are vertically spaced apart and each contain aligned openings 38 therein within which the test tubes 12 are received in particular position. In this respect, the openings 38 in the top shelf 34 are each partially surrounded by spaced apart, cooperating positioning rear shoulder pairs 40 upon a top surface 41 of top shelf 34 which define an opening 42 therebetween which is configured to receive therein the hinge 16 of each cap 14 to ensure identical alignment to all of the caps 14 relative to a pivotable lid 44 which engages over the caps 22 when desired, to simultaneously open a plurality of same.

The retractable pivotable lid 44 includes a notched flange 46 used to open the caps 14 when desired by sliding into engagement with the cap nubs and raising the caps by pivoting the lid to the up orientation. Alternatively, the pivotable lid 44 may also be retracted when the lid is in the down orientation while leaving the caps 14 closed, such as for removal of the test tubes 12 from the assembly 10.

The pivotable lid 44 extends across a width of the assembly 10 and includes two end hinge trunnions 52 toward a rear end edge 54 thereof, the trunnions 52 being of any suitable configuration for engaging a slotted bracket 55 and for allowing the lid 44 to slide into engagement with the test tubes 12 positioned within the assembly 10 and to pivot in line with the living hinges 16 of the test tubes 12, as will be defined below.

Although shown as a separate member in this embodiment, the lid 44, could, for example, be formed of separate elements for ease of manufacture. Thus, the exemplary embodiment of the assembly 10 should not be construed as limiting as to scope. It will be seen that the lid 44 incorporates trunnions 52 at each end which engage in slots 130 in the side brackets 55 so as to be slidable, together, forwardly and rearwardly along a horizontal plane.

The lid 44 is configured for use in opening the caps 22 on the plurality of test tubes 12 within the assembly 10, simultaneously. When the lid 44 is horizontal and slid into in this rearward second position after being placed horizontally over the test tubes 12 and the pivotable lid 44 is pivoted to the near-vertical, the caps 22 on the test tubes 12 are simultaneously opened for access to content within the test tubes 12. A truncated cylinder 129 aligns with a static member 132 in the side brackets 55 to prevent the lid 44 from being raised until the nubs 24 of the tube caps 14 have been engaged by the notched flange 46 and the lid is in the second position. This opening, and closing, of multiple test tubes 12 simultaneously saves many man hours of work as compared to the opening and closing of test tubes 12 one at a time, as will be obvious to one skilled in the art.

When closing of the test tubes 12 is desired, such as for removal thereof, it will be understood that the pivotable lid 44 is pivoted to be horizontal by moving the lid operating bar 98 forwards and downwards to assist when the pivotable lid 44 is pushed down against the caps 22. When the pivotable lid 44 is so positioned and now moved in a forward direction to the first position, the test tubes 12 are all closed against spillage and easily removable from the assembly 10 through use of a test tube extraction lever 90, to be defined below.

With respect to lifting of the test tubes 12 slightly out of seating within the openings 38 and alignment shoulders 40, a finger pivot 92 is provided along each mirror image end 93 of the base 30 which is manipulated by pushing down on a forward pivot tip 94 which moves a rearward end 95 of the finger pivot 92 upwardly, to which an end of the platen 90 is engaged, the narrow elongate platen 90 extending across a lateral extent of the assembly 10, raising the platen 90 and pushing up on bottom ends 96 of test tubes 12 for ease in grasping of each test tube 12. It will be seen that, in a preferred embodiment, the pivotable member 90 is pivotably engaged to an upstanding support 104 for same provided on and raised above the base 30 to allow for pivotability.

The pivoting of lid 44 from the horizontal to near-vertical orientation is accomplished through provision of the lid operating bar 98 provided which extends across the lateral extent of the lid 44 along a forward end area 100 thereof as well and when pivoted upwardly causes the pivotable lid 44 toward the near-vertical orientation thereof.

It will be understood that the test tube lid operating bar 98 for the lid 44 is provided for simplifying operation and is accessory rather than absolutely necessary for function in opening and closing a plurality of test tubes 12 simultaneously as will be understood by those skilled in the art. The assembly 10 could just as easily be operated manually to perform these tasks without undue burden on the user.

It will be seen that the pivotable lid operating bar member 98 is pivoted to the pivotable lid 44 on pins 123 and has further pins 122 which react against contoured slots 131 in the side brackets 55 to guide, provide mechanical advantage for the uncapping an recapping of the test tubes 12 with the lid 44 in the horizontal and rearward first position when the pins 122 engage in the rear end 133 of the horizontal section of the contoured slot 131, and lock the pivotable lid 44 in the near-vertical orientation by engaging in a detent 126 which forms the upper part of the contoured slots 131 for filling/emptying the test tubes 12. The pivoting of lid 44 from the near-vertical to horizontal orientation is accomplished by the lid operating bar 98 when pivoted downwardly with mechanical advantage being achieved by pins 122 reacting on the contoured slots 131 with additional force provided to the center of the lid 44 by a tab 124 on the lid operating bar 98 contacting a tab 125 on the lid 44. When in the horizontal orientation the lid 44 is moved forwards to the second position to provide access to the test tubes 12 only after all the tube caps 14 have been closed and sealed. Tabs 127 on the lid 44 located in slots 128 on the side brackets 55 and prevent sliding until all the test tube caps 14 have been fully closed and the lid 44 is fully in the horizontal orientation.

Figure 6:
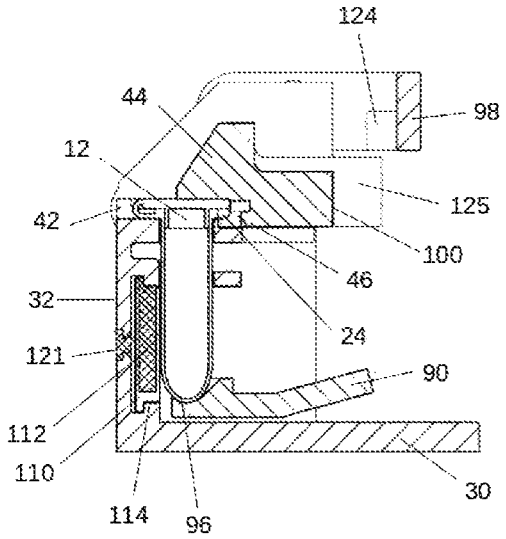
FIG. 6 presents a sectioned view of the exemplary Laboratory Test Tube Handling Device in the down and engaged first position.
Figure 7:
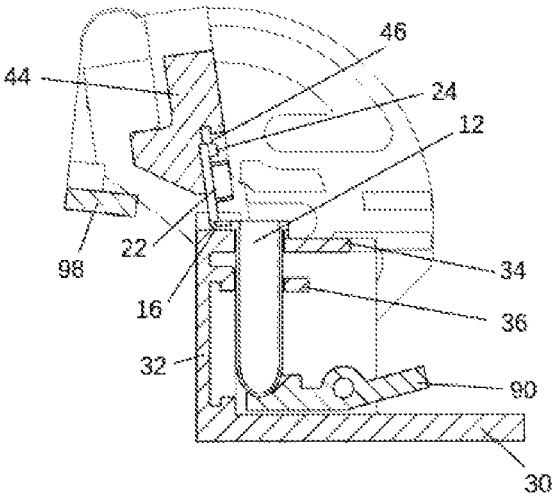
FIG. 7 presents a sectioned view of the exemplary Laboratory Test Tube Handling Device in the up first position with the test tubes uncapped for filling or emptying for testing.
Figure 8:
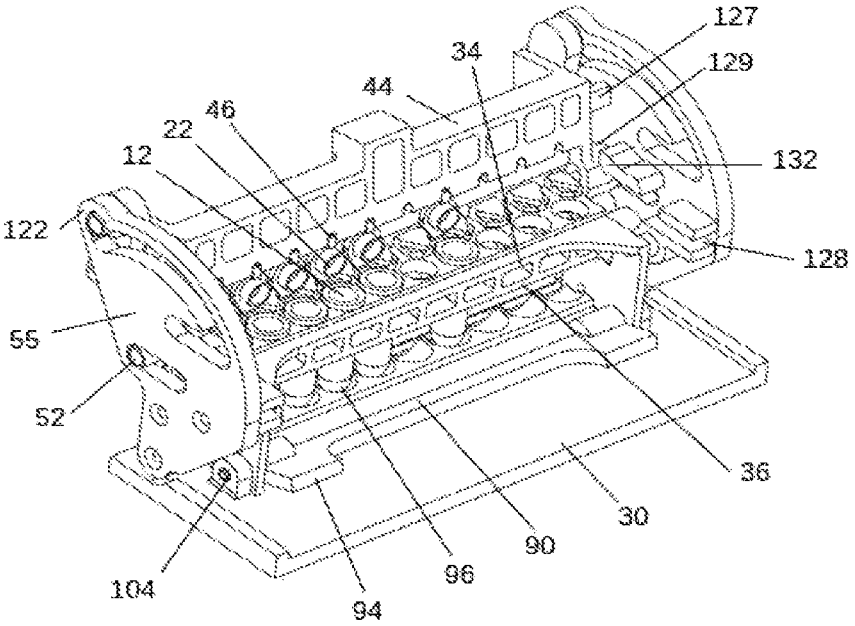
FIG. 8 presents a frontal isometric view of the exemplary Laboratory Test Tube Handling Device in the up first position with the tube caps open.
Figure 9:
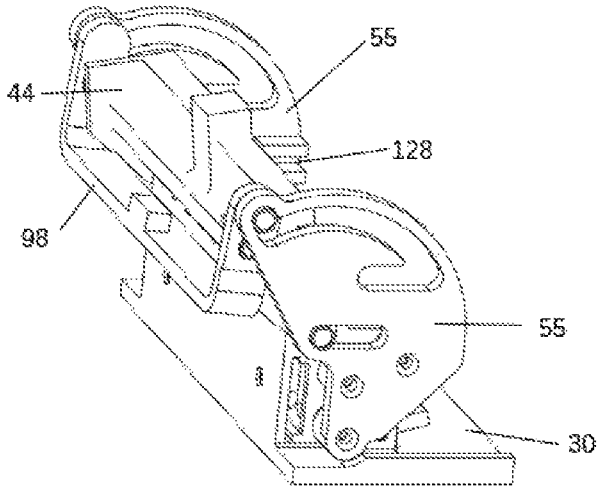
FIG. 9 presents a rear isometric view of the exemplary Laboratory Test Tube Handling Device in the up first position with the tube caps open.

Further, a magnetic accessory 110 for magnetic separation of content within the test tubes 12 when desired may also be provided. In this respect, in one embodiment, an elongate lateral slot 112 may defined by a space between the rear wall 32 and upstanding flanges 114 spaced forwardly of rear wall 32 on the base 30 as shown in FIG. 6. The magnetic accessory 110 is kept in alignment with the tubes by means plugs 121 of magnetic material fitted to the rear wall 32 in line with some of the test tube 12 locations. The magnetic accessory 110 in a preferred embodiment comprises a strip of permanent magnets 112 or the like which is configured to align each permanent magnet 112 behind one of the plurality of test tubes 12 within the assembly 10.

As described above, the assembly 10 of the present invention provides a number of advantages, some of which have been described above and others of which are inherent in the invention. Also, modifications may be proposed to the apparatus 10 without departing from the teachings herein. Accordingly, the scope of the invention is only to be limited as necessitated by the accompanying claims.

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

The invention claimed is:

1. A simplified assembly for simultaneously opening a plurality of capped test tubes, the test tubes including caps configured to engage over an open end of each of said test tubes, each cap including a circumferential collar engaged about the open end of each of said test tubes and each cap being engaged to the collar by a living hinge at one circumferential position therealong and having a locking nub at an opposite circumferential position therealong which coacts with a slot in the collar for locking the cap to the collar, the assembly comprising a horizontal base from which a rear wall extends upwardly, a pair of vertically spaced apart test tube receiving and aligning shelves extending from the rear wall over said base and having aligned openings therein for aligned positioning of the test tubes vertically beneath a working planar pivotable lid of the apparatus, the working pivotable lid comprising a substantially planar element having a center support member and being slidably mounted to side support members, the bottom planar surface of the planar lid having structure thereon for engaging the locking nub of each cap when in a first position thereof to simultaneously release and open each cap of the plurality of capped test tubes therebeneath and when in a second position thereof, allowing the pivotable lid to pivot upwardly without releasing the caps.

2. The assembly of claim 1 wherein the slidable, pivorable lid slides rearwardly and forwardly upon the base 30 via the side support members which incorporate coacting curved openings extending rearwardly and forwardly therein, within each of which one end of the lid is slidably engaged.

3. The assembly of claim 1 wherein the caps of the test tubes are uncapped by the lid when it is rearwardly positioned in a near-vertical orientation.

4. The assembly of claim 1 wherein the caps of the test tubes remain capped when the lid is positioned in a horizontal orientation, either in a rearwardly or in a forwardly position relative to the coacting curved openings.

5. The assembly of claim 1 wherein a notched flange pivotably positioned beneath the test tubes is pivoted upwardly for ease in grasping of the test tubes, when desired.

6. The assembly of claim 1 wherein an accessory pivotable lid operating bar is pivoted to raise the assembly lid to pivot the lid to a near-vertical orientation on pins which react against contoured slots in the side supports to guide and provide mechanical advantage for the uncapping and recapping of the test tubes and to lock the pivotable lid in the near-vertical orientation by engaging in a detent which forms part of the contoured slots for filling/emptying the test tubes.

7. The assembly of claim 6 wherein the pivoting of the lid from the near vertical to horizontal orientation is accomplished by the lid operating bar when pivoted downwardly with mechanical advantage being achieved by pins reacting with the contoured slots with additional force provided to the center of the lid by a tab provided on the lid operating bar contacting a coacting tab on the lid.

8. The assembly of claim 1 wherein an accessory magnetic strip is provided for magnetically separating contents within the test tubes.

9. The assembly of claim 8 wherein a slot for the accessory magnetic strip is provided forward of and adjacent to the rear wall of the assembly.

10. The assembly of claim 8 wherein the magnetic accessory strip incorporates permanent magnets which align behind tubes located within the assembly.

11. The assembly of claim 1 wherein a top one of the vertically aligned spaced apart shelves having openings therein also includes alignment shoulders on a top surface thereof for aligning the hinges of the test tube caps toward a rear of the assembly.

12. The assembly of claim 1 wherein the planar lid has cutouts therein which engage over the caps of the test tubes and which, when in the first position thereof, release the locking nubs of each cap from engagement with a slot in the collar.

13. The assembly of claim 1 wherein the assembly lid has cutouts therein which engage over the caps of the test tubes and which, when in the second position thereof, do not release the locking nub of each cap from engagement with a slot in the collar, with each cap remaining engaged over the respective test tube.

14. The assembly of claim 1 wherein each cutout in the assembly lid includes an undercut forward edge which engages between the cap and the test tube to release the nub from engagement within the slot of the collar when the assembly lid is in the first position thereof.

15. The assembly of claim 1 wherein a preferred plurality of test tubes to simultaneously be opened is more than one.

16. The assembly of claim 1 wherein the preferred plurality of test tubes to be simultaneously opened is 10.

17. The assembly of claim 1 wherein the preferred plurality of test tubes to be simultaneously opened is more than 10.

18. The assembly of claim 1 wherein the kinematics of motion of the lid after engaging the tube caps together with the location of the body of the tubes in the two separate shelves and the locating slots in the top shelf aligning the tubes by the protrusions formed by the cap hinges are such the the cutouts in the top member remain in full contact with the nub of each cover during the full motion of the lid from the horizontal orientation to the near-vertical orientation and the reverse motion.

19. The assembly of claim 1 wherein a truncated cylinder coaxial with the trunion at each end of the lid aligns with a static member which allows rotation only in the first position preventing raising of the lid except in that position when the lid cutouts are engaged with the tube cap nubs by preventing the trunion from moving out of the first position thereby ensuring continued engagement of the cutouts in the lid member with the nub of each cover when the cover is opened.

20. The assembly of claim 1 wherein the lid incorporates a rigid beam which runs a full width of the lid and is aligned with the tube caps in the first position during the closing motion and creates a cap closing force against the upper shelf to ensure all caps are equally closed and sealed before the lid is moved to the second position.

* * * * *